US006864772B2

(12) United States Patent
Callis et al.

(10) Patent No.: US 6,864,772 B2
(45) Date of Patent: Mar. 8, 2005

(54) ENCAPSULATED SOLENOID ASSEMBLY HAVING AN INTEGRAL ARMOR TUBE CABLE PROTECTOR

(75) Inventors: Brad Callis, Greentown, IN (US); Dano Vannette, Fort Wayne, IN (US)

(73) Assignee: Delaware Capital Foundation, Inc., Wilmington, DE (US)

( * ) Notice: Subject to any disclaimer, the term of this patent is extended or adjusted under 35 U.S.C. 154(b) by 109 days.

(21) Appl. No.: 10/358,489

(22) Filed: Feb. 5, 2003

(65) Prior Publication Data

US 2004/0149948 A1 Aug. 5, 2004

(51) Int. Cl.[7] ..... H01F 7/08
(52) U.S. Cl. ..... 335/260; 335/278
(58) Field of Search ..... 335/255, 260, 335/278; 336/90–96, 105, 107, 192

(56) References Cited

U.S. PATENT DOCUMENTS

| | | | | |
|---|---|---|---|---|
| 3,598,360 A | | 8/1971 | Merriner et al. | |
| 4,213,108 A | | 7/1980 | Gross | |
| 4,217,567 A | | 8/1980 | Roy et al. | |
| 4,233,584 A | * | 11/1980 | Fussner | 335/260 |
| 4,266,844 A | | 5/1981 | Chelminski | |
| 4,299,374 A | * | 11/1981 | Yamanaka | 251/129.21 |
| 4,419,641 A | | 12/1983 | Slavin et al. | |
| 4,515,345 A | | 5/1985 | Inden et al. | |
| 4,882,558 A | | 11/1989 | Takayanagi | |
| 4,988,073 A | * | 1/1991 | Cristiani | 251/129.01 |
| 5,311,162 A | | 5/1994 | Sjoquist et al. | |
| 5,538,220 A | | 7/1996 | LaMarca | |
| 5,681,099 A | | 10/1997 | Steffes et al. | |
| 6,012,700 A | | 1/2000 | Johnson et al. | |
| 6,086,042 A | | 7/2000 | Scott et al. | |
| 6,121,865 A | | 9/2000 | Dust et al. | |
| 6,310,533 B2 | | 10/2001 | Coulombier | |
| 6,398,586 B1 | | 6/2002 | Muzslay | |

* cited by examiner

*Primary Examiner*—Ramon M. Barrera
(74) *Attorney, Agent, or Firm*—Woodard, Emhardt, Moriarty, McNett & Henry LLP

(57) ABSTRACT

An encapsulated solenoid assembly including an electronic actuator and an elongate metallic armor tube for receiving an electrical conductor therethrough which is electrically connected to the electronic actuator. The electronic actuator and an end portion of the armor tube are encapsulated within an outer casing of encapsulation material to integrally couple the armor tube with the electronic actuator without the use of additional connection components or complex attachment arrangements. In one embodiment, the armor tube is corrugated to facilitate bending and to aid in maintaining engagement with the encapsulation material. In another embodiment, the electronic actuator includes a magnetic plunger that is displaceable along an actuation axis, with the armor tube extending along a longitudinal axis laterally offset from the actuation axis. In a further embodiment, the electrical conductor extends alongside a substantial length of the electronic actuator so as to become embedded within the outer shell of encapsulation material.

29 Claims, 2 Drawing Sheets

ENCAPSULATED SOLENOID ASSEMBLY HAVING AN INTEGRAL ARMOR TUBE CABLE PROTECTOR

FIELD OF THE INVENTION

The present invention relates generally to the field of solenoids, and more particularly relates to an encapsulated solenoid assembly having an integral armor tube cable protector.

BACKGROUND OF THE INVENTION

Solenoid devices are used in a wide variety of automotive and industrial applications to control the flow of a gas or fluid. In such applications, the solenoid may by exposed to relatively harsh environments, including exposure to moisture, contaminants or corrosive substances that may adversely affect operation of the solenoid and/or lead to premature failure of the solenoid. As a result, solenoid devices are sometimes encapsulated in an outer layer of protective material to provide a barrier between the internal working components of the solenoid device and the external environment.

Encapsulated solenoids are typically designed such that the electrical leads that provide power and/or control signals to the solenoid extend laterally through the outer shell of encapsulation material or through a preformed opening or conduit. However, such routing tends to compromise fluid or contamination resistance. In some instances, and particularly in applications involving exposure to harsh or severe environmental factors, the exposed electrical leads may require some form of protection to avoid damage or premature wear. In some cases, an external sheath or cable housing is attached to the outer surface of the encapsulated solenoid body via rivets or other types of fasteners. In other cases, an external sheath or cable housing may be secured directly to the inner components of the solenoid prior to encapsulation of the solenoid body.

Regardless of which of the above techniques is used, attachment of an external sheath or cable housing to the solenoid body involves the use of a complex attachment arrangement and/or multiple fastener components, is typically time consuming, and may require precise alignment with preformed openings, all of which tend to increase the costs associated with manufacturing and assembling the solenoid. Maintaining an adequate seal between the electrical leads and the solenoid body may also present difficulties.

Thus, there is a general need in the industry to provide an improved encapsulated solenoid assembly and a method for manufacturing the same. The present invention meets this need and provides other benefits and advantages in a novel and unobvious manner.

SUMMARY OF THE INVENTION

The present invention relates generally to an encapsulated solenoid and a method for manufacturing the same. While the actual nature of the invention covered herein can only be determined with reference to the claims appended hereto, certain forms of the invention that are characteristic of the preferred embodiments disclosed herein are described briefly as follows.

In one form of the present invention, a solenoid assembly is provided, comprising an electronic actuator, an elongate tube member, an electrical conductor extending through the elongate tube member and electrically connected to the electronic actuator, and an encapsulation material surrounding the electronic actuator and an end portion of the elongate tube member, with the elongate tube member coupled to the electronic actuator solely by the encapsulation material.

In another form of the present invention, a solenoid assembly is provided, comprising an electronic actuator, an elongate armor tube, an electrical conductor extending through the elongate armor tube and electrically coupled to the electronic actuator, and an encapsulation material surrounding the electronic actuator and an end portion of the elongate armor tube to couple the elongate armor tube to the electronic actuator.

In yet another form of the present invention, a method is provided for manufacturing a solenoid assembly, comprising providing an electronic actuator, an elongate tube member and an electrical conductor, inserting the electrical conductor through the elongate tube member, electrically connecting the electrical conductor to the electronic actuator, and encapsulating the electronic actuator and an end portion of the elongate tube member with an encapsulation material to couple the elongate tube member to the electronic actuator.

It is one object of the present invention to provide an improved encapsulated solenoid assembly. It is another object of the present invention to provide an improved method for manufacturing an encapsulated solenoid assembly.

Further objects, features, advantages, benefits, and further aspects of the present invention will become apparent from the drawings and description contained herein.

DESCRIPTION OF THE ILLUSTRATED EMBODIMENTS

Figure 1:
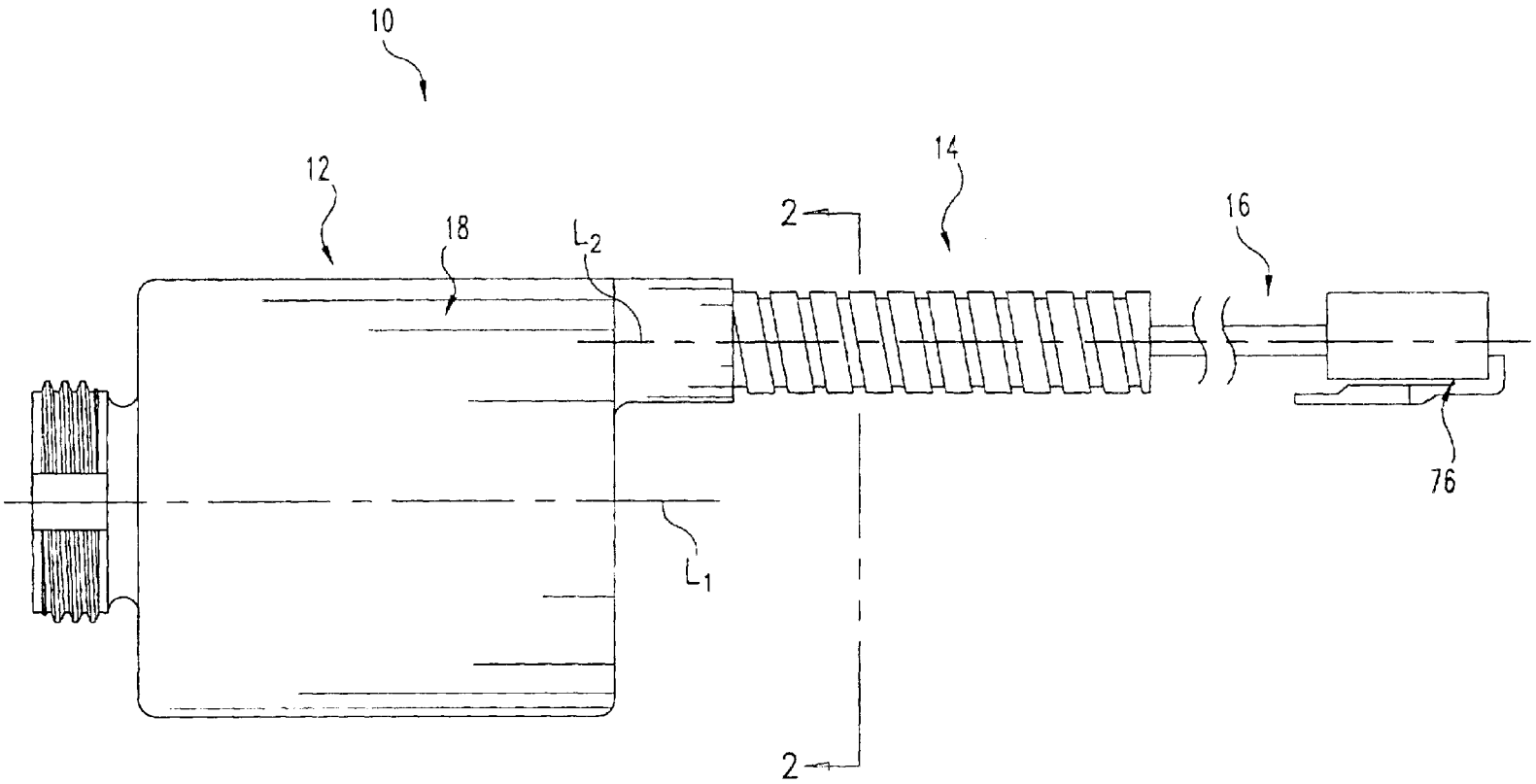
FIG. 1 is an encapsulated solenoid assembly according to one form of the present invention.

For the purposes of promoting an understanding of the principles of the invention, reference will now be made to the embodiments illustrated in the drawings and specific language will be used to describe the same. It will nevertheless be understood that no limitation of the scope of the invention is hereby intended, such alterations and further modifications in the illustrated devices, and such further applications of the principles of the invention as illustrated herein being contemplated as would normally occur to one skilled in the art to which the invention relates.

Referring to FIG. 1, shown therein is a solenoid assembly 10 according to one form of the present invention. The solenoid assembly 10 is generally comprised of an electronic actuator 12, an elongate tube member 14, and an electrical conductor 16 extending through the elongate tube member 14 and electrically connected to the electronic actuator 12. An encapsulation material 18 surrounds the electronic actuator 12 and an end portion of the elongate tube member 14 to integrally couple the elongate tube member 14 to the electronic actuator 12, the details of which will be discussed below.

In one embodiment of the invention, the solenoid assembly 10 is a two-way solenoid having an open operational position and a closed operational position. However, other operational configurations of solenoids are also contemplated for use in association with the present invention. As should be appreciated, the solenoid assembly 10 may be used in a number of applications to electronically control the flow of a gas or fluid from a remote location via transmission of one or more electronic signals through the electrical conductor 16 to the electronic actuator 12, the details of which would be apparent to one of skill in the art and therefore need not be discussed herein.

Figure 3:
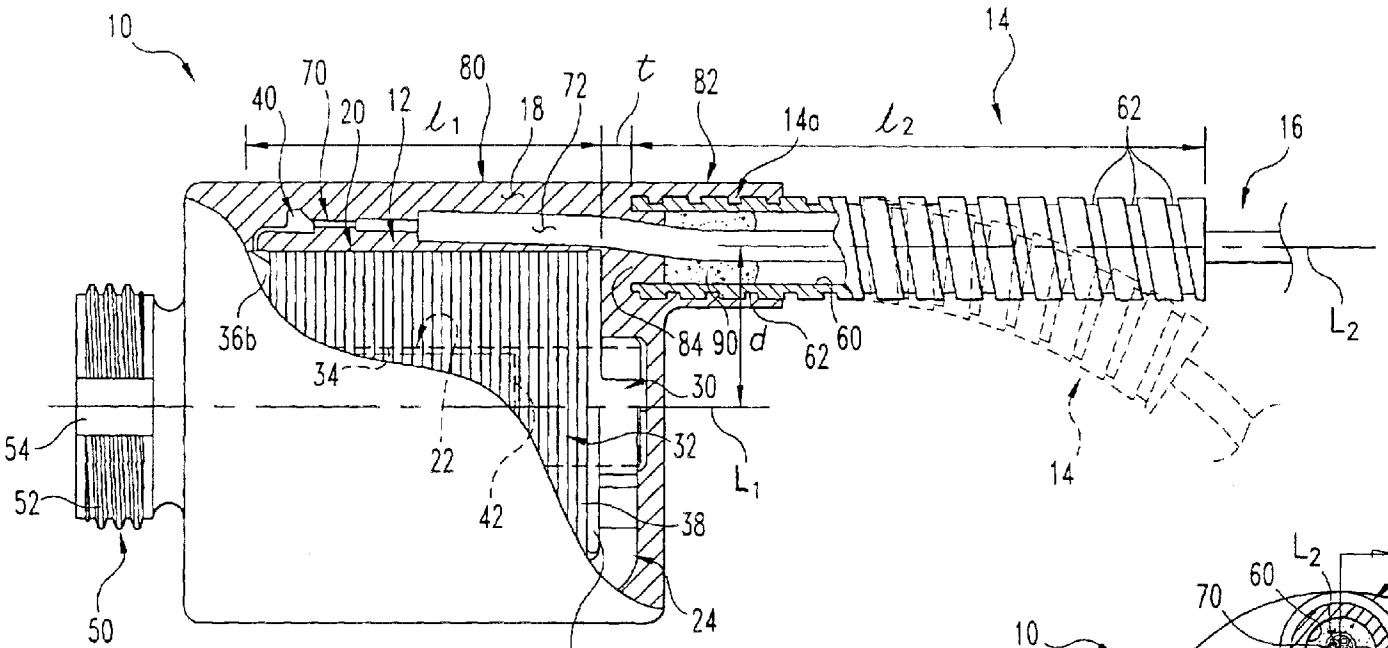
FIG. 3 is a partial cross-sectional view of the encapsulated solenoid assembly illustrated in FIG. 2, as viewed along line 3—3 of FIG. 2.
Figure 2:
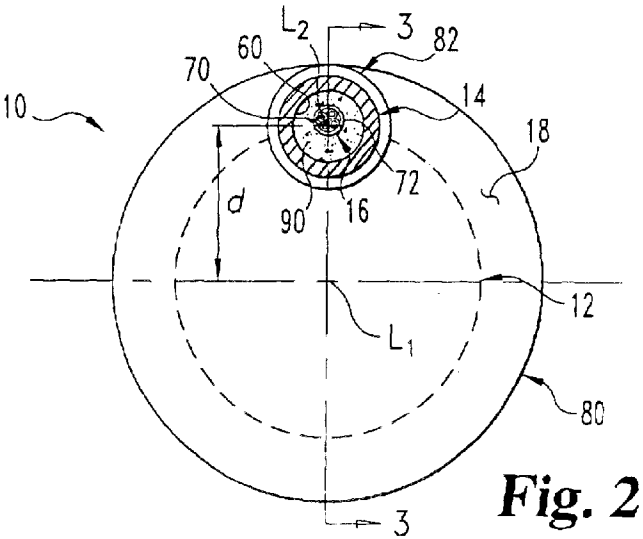
FIG. 2 is a cross-sectional view of the encapsulated solenoid assembly illustrated in FIG. 1, as viewed along line 2—2 of FIG. 1.

Referring to FIGS. 2 and 3, the electronic actuator 12 extends along a longitudinal actuation axis $L_1$ and is generally comprised of a coil assembly 20, an actuator mechanism 22, a valve mechanism (not shown), and a magnetically responsive yoke member 24, the details of which will be discussed below.

The coil assembly 20 is generally comprised of a bobbin 30 and an energizing coil 32. The bobbin 30 defines a interior region or passage 34 extending generally along the actuation axis $L_1$ and an exterior region having a length $l_1$ defined between a pair of outwardly extending ribs or flanges 36*a*, 36*b* disposed adjacent opposite ends of the coil assembly 20. The energizing coil 32 is comprised of an electrically conductive wire 38 wound about the exterior region of said bobbin 30 between the ribs 36*a*, 36*b*. A pair of electrical terminals or lead supports 40 (FIG. 3) are mounted to the bobbin rib 36*b* and are electrically connected to respective ends of the energizing coil wire 38.

The actuator mechanism 22 comprises a magnetic plunger or armature member 42 disposed within the interior region 34 of the bobbin 30. The magnetic plunger 42 is adapted for reciprocating displacement along the actuation axis $L_1$ upon energizing and de-energizing of the coil 32. As would be appreciated by one of skill in the art, the magnetic plunger 42 operates to open and/or close a valve mechanism (not shown) to correspondingly control the flow of a gas or fluid. As would also be appreciated by one of skill in the art, the actuator mechanism 22 may include additional components, such as, for example, a magnetic core member stationarily disposed adjacent the plunger 42, a biasing spring configured to return the valve mechanism to an open/closed operational position upon de-energizing of the coil 32, or any other actuator component that would occur to one of skill in the art.

The valve mechanism (not shown) may include a valve pad or seal member mounted to an end of the magnetic plunger 42 and disposed opposite a stationary valve seat or seal. Energizing the coil 32 generates an electromagnetic force which axially displaces the magnetic plunger 42 and the valve pad relative to the valve seat, which in turn opens or closes the valve to correspondingly control the flow of a gas or fluid therethrough. As shown in FIG. 3, the solenoid assembly 10 may be provided with an integral coupling stem 50 adapted for releasable engagement with a female coupling member attached to a pipe or conduit disposed in communication with a gas or fluid source. In one embodiment of the invention, the coupling stem 50 defines external threads 52 adapted for threading engagement with an internally threaded passage formed along a female coupling member. The coupling stem 50 may include one or more flattened areas 54 for engagement by a driving tool to aid in threading the coupling stem 50 into the female coupling member. In other embodiments, the coupling stem 50 may define internal threads adapted for threading engagement with an externally threaded portion of a male coupling member. In still other embodiments, alternative means for connecting the solenoid assembly 10 with a gas or fluid source are also contemplated, such as, for example, a sealed connection, a compression-type fitting, or a welded connection.

The magnetically responsive yoke member 24 comprises a U-shaped bracket having a base portion extending along the length $l_1$ of the coil assembly 20 and a pair of flange portions defining cut-out areas sized to receive corresponding end portions of the bobbin 30 therein. As shown in FIG. 3, the flange portions of the U-shaped bracket 24 are positioned adjacent the ribs 36*a*, 36*b* of the bobbin 30, with the base portion of the U-shaped bracket 24 extending along and partially surrounding the coil 32 and positioned generally opposite the lead supports 40. In one embodiment of the invention, the frame member 24 is formed of C1018 cold rolled steel. However, use of other magnetically responsive materials are also contemplated, such as, for example, a stainless steel material.

Although a particular embodiment of an electronic actuator 12 has been illustrated and described herein, it should be understood that other types and configurations of electronic actuators are also contemplated as falling within the scope of the present invention, and that the particular embodiments of the coil assembly 20, the actuator mechanism 22, the valve mechanism, and the magnetically responsive yoke member 24 are exemplary only. Further details regarding another embodiment of an electronic actuator suitable for use in association with the present invention are illustrated and described in U.S. Pat. No. 6,086,042 to Scott et al., the contents of which are hereby incorporated by reference in their entirety.

The elongate tube member 14 defines an interior passageway 60 sized to receive the electrical conductor 16 therethrough. In one embodiment of the invention, the elongate tube member 14 and the passageway 60 extend along a longitudinal axis $L_2$ that is laterally offset from the actuation axis $L_1$ by a distance d, the importance of which will be discussed below. In a preferred embodiment of the invention, the elongate tube member 14 is an armor tube designed to protect or shield the portion of the electrical conductor 16 extending from the solenoid body from damage and/or wear. The protective armor tube 14 is preferably formed of a metallic material having good corrosion resistance characteristics, such as, for example, a stainless steel material. However, other materials are also contemplated, such as, for example, other types of steel materials, an aluminum material, a plastic material, or a composite material.

In one embodiment of the invention, at least a portion of the elongate tube member 14 extending from the encapsulated solenoid body has a corrugated configuration to facilitate bending to a non-linear configuration, such as, for example, the curved configuration illustrated in FIG. 3 in phantom. In one embodiment of the invention, the elongate tube member 14 defines a series of undulations or circumferential grooves 62 formed along the exterior of the elongate tube member 14 to facilitate bending. In the illustrated embodiment, the corrugation grooves 62 are oriented at an oblique angle relative to the longitudinal axis $L_2$, are uniformly offset relative to one another, and have a uniform groove depth. However, it should be understood that other configurations of the grooves 62 are also contemplated as falling within the scope of the present invention. For example, the corrugation grooves 62 may be oriented perpendicular to the longitudinal axis $L_2$, may be offset from one another at varying distances, and may have varying groove depths. Additionally, the corrugation grooves 62 may be formed as a single, continuous groove extending along the length of the elongate tube member 14 so as to define a spiral or helical groove configuration.

The end portion 14*a* of the elongate tube member 14 embedded within the encapsulation material 18 is also preferably corrugated to aid in maintaining engagement within the encapsulation material 18. As should be appreciated, the corrugation grooves 62 formed along the end portion 14*a* of the elongate tube member 14 are filled with encapsulation material 18 during the encapsulating process to enhance the bond between the tube member 14 and the encapsulation material 18. As a result, the end portion 14*a* of the tube member 14 is securely anchored within the encapsulation material 18, which in turn securely and integrally couples the elongate tube member 14 to the electronic actuator 12.

In a preferred embodiment of the invention, the elongate tube member 14 is corrugated along substantially its entire length 12 to both facilitate bending and to provide improved anchoring within the encapsulation material 18. In one embodiment, the length $l_2$ of the elongate tube member 14 is at least one-half of the length $l_1$ of the coil assembly 20 to provide adequate protection to the portion of the electronic conductor 16 extending from the encapsulated solenoid body. In another embodiment, the length $l_2$ of the elongate tube member 14 is equal to or greater than the length $l_1$ of the coil assembly 20. However, it should be understood that other length $l_2$ of the elongate tube member 14 may also be used.

The electrical conductor 16 extends through the passageway 60 in the elongate tube member 14 for electrically connection to the electronic actuator 12. In one embodiment of the invention, the electrical conductor 16 comprises a multi-conductor cable including a number of insulated electrical lead wires 70. In a specific embodiment, the multi-conductor cable 16 is a telephone-style cable including four electrical leads 70 surrounded by an outer protective jacket 72. However, it should be understood that other styles of cable are also contemplated and that the cable 16 may be provided with any number of electrical leads, including one, two, three, or five or more electrical leads. It should also be understood that the electrical leads 70 need not necessarily be integrated into a cable assembly, but may extend individually through the elongate tube member 14.

As shown in FIG. 3, two of the electrical leads 70 are connected to respective ones of the lead supports 40 mounted to the rib 36*b* of the bobbin 30, which are in turn electrically connected to respective ends of the energizing coil wire 38. Notably, the electrical leads supports 40 are positioned at the far end of the electronic actuator 12, opposite the elongate tube member 14, the importance of which will be discussed below. In one embodiment of the invention, the ends of the electrical leads 70 terminate in a modular plug 76 (FIG. 1) adapted for quick and convenient connection to a power source or an electronic controller (not shown). As would be apparent to one of skill in the art, power and/or electronic control signals are transmitted through the electrical leads 70 to operate the electronic actuator 12 from a remote location.

Following assembly of the electronic actuator 12 and connection of the electrical leads 70 to the lead supports 40, the electronic actuator 12 and the end portion 14*a* of the elongate tube member 14 are encapsulated within the encapsulation material 18. In the illustrated embodiment of the invention, the encapsulation material 18 forms a substantially cylindrical main body portion 80 about the electronic actuator 12 and a substantially cylindrical stem portion 82 about the end portion 14*a* of the elongate tube member 14. The stem portion 82 extends from and is formed integral with the main body portion 80 so as to define a unitary encapsulation shell surrounding the solenoid body. It should be appreciated that other shapes and configurations of the main body portion 80 and the stem portion 82 of the encapsulation shell are also contemplated, such as, for example, rectangular configurations or hexagonal configurations.

In one embodiment of the invention, the electronic actuator 12 and the end portion 14*a* of the elongate tube member 14 are encapsulated via a molding process, such as, for example, an injection molding process. In a preferred embodiment, the electronic actuator 12 and the end portion 14*a* of the tube member 14 are positioned within a mold (not shown) and the encapsulation material 18 is injected into the mold under pressure to form the outer shell of encapsulation material 18. The mold may include interchangeable elements to form various thread patterns or other types of connection means on the coupling stem 50 to provide means for interconnection with a gas or fluid source.

As should be appreciated, the encapsulation material 18 surrounding the electronic actuator 12 provides a protective barrier between the components of the electronic actuator 12 and the external environment. As a result, the solenoid assembly 10 is protected from exposure to moisture, contaminants, corrosive substances or other elements which might otherwise adversely affect operation of the solenoid assembly 10, and particularly with regard to operation of the electronic actuator 12. Additionally, as shown in FIG. 3, the end portion 14*a* of the elongate tube member 14 is preferably offset from the electronic actuator 12 to form a layer or deposit 84 of encapsulation material 18 about the electrical conductor 16 immediately adjacent the passageway 60. In one embodiment, the end portion 14*a* of the tube member 14 is axially offset from the electronic actuator 12 to form a layer 84 of encapsulation material 18 therebetween having a thickness t. The encapsulation layer or deposit 84 serves to provide an additional barrier between the internal components of the solenoid assembly 10 and the external environment by closing off or sealing the end of the passageway 60 extending through the tube member 14.

In addition to protecting the solenoid assembly 10 from the external environment, the encapsulation material 18 also serves to integrally couple the elongate tube member 14 to the electronic actuator 12. Notably, the elongate tube member 14 is coupled to the electronic actuator 12 solely by the encapsulation material 18, thereby eliminating the need for additional connection components or complex attachment arrangements. Moreover, since the end portion 14*a* of the elongate tube member 14 is surrounded by the encapsulation material 18, there is no need to provide an additional sealing element to maintain a fluid-tight seal between the elongate tube member 14 and the solenoid body. Accordingly, the costs associated with manufacturing and assembling the solenoid assembly 10 are significantly reduced. Additionally, since there are no requirements for precise alignment of connection components with preformed openings, the time required to assemble the solenoid assembly 10 is reduced, also tending to reduce the costs associated with manufacturing and assembling the solenoid assembly 10.

As illustrated in FIG. 3, the electrical conductor 16 extends alongside the coil assembly 20 from a first end of the coil assembly 20 adjacent the bobbin rib 36*a* toward a second end of the coil assembly 20 adjacent the bobbin rib 36*b*. In a preferred embodiment of the invention, the electrical conductor 16 extends along substantially the entire length $l_1$ of the coil assembly 20. In this manner, a significant portion of the electrical conductor 16 is embedded within the encapsulation material 18. It should be appreciated that embedding a significant portion of the electrical conductor 16 within the encapsulation material 18 enhances the fluid resistant properties of the solenoid assembly 10 by creating an elongated fluid wicking path. Additionally, embedding a significant portion of the electrical conductor 16 within the encapsulation material 18 reduces the likelihood that the electrical leads 70 will pull away or become separated from the lead supports 40.

Notably, embedding a significant portion of the electrical conductor 16 within the encapsulation material 18 is made possible by designing the solenoid assembly 10 such that the longitudinal axis $L_2$ of the elongate tube member 14 is laterally offset from the electronic actuator 12. In a preferred embodiment of the invention, the longitudinal axis $L_2$ of the elongate tube member 14 is laterally offset from the actuation axis $L_1$ such that the electrical conductor extends along the length of the coil assembly 20. As should be appreciated, embedding a significant portion of the electrical conductor 16 within the encapsulation material 18 would not be possible if the elongate tube member 14 were aligned over a central portion of the electronic actuator 12.

The encapsulation material 18 used in association with the present invention preferably exhibits good electrical insulation and thermal dissipation properties and is resistant to water, contaminants, corrosive substances or other potentially harmful environmental elements. Additionally, the encapsulation material 18 is preferably suitable for use in an injection molding process. In one embodiment of the invention, the encapsulation material 18 is at least partially comprised of a plastic material, such as, for example, a nylon material. In a specific embodiment, the encapsulation material 18 is a reinforced nylon material, such as, for example, Nylon 6/6 which is comprised of a molded 6/6 nylon and a glass reinforcement material. However, it should be understood that other encapsulation materials may also be used in association with the present invention. For example, the encapsulation material 18 may be comprised of an epoxy material, a resin material, such as a high strength polypropylene resign, or a fiber-filled molding compound, such as a copolymer polyester molding compound. Other suitable encapsulation materials are also contemplated as would occur to one of skill in the art.

As shown in FIG. 3, a filler material 90 is preferably positioned within the passageway 60 of the elongate tube member 14 and about the electrical conductor 16 to prevent the encapsulation material 18 from flowing through the passageway 60 and out the far end of the tube member 14 during the injection molding process. In one embodiment, the filler material 90 comprises a potting material, such as, for example, an RTV material. As should be appreciated, the potting material 90 provides a fluid-tight seal between the elongate tube member 14 and the electrical conductor 16 to further enhance the fluid resistant properties of the solenoid assembly 10. The potting material 90 also serves to maintain the electrical conductor 16 in a stationary position relative to the elongate tube member 14 to reduce frictional wear and to absorb forces or stresses that would otherwise be absorbed directly by the electrical conductor 16. Although the potting material 90 is illustrated and described as being positioned within the passageway 60 adjacent the end portion 14*a* of the tube member 14, it should be understood that the potting material 90 may be positioned within other portions of the passageway 60 or along the entire length of the passageway 60.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A solenoid assembly, comprising:

an electronic actuator;

an elongate tube member defining a passageway extending therethrough;

an electrical conductor extending through said passageway and electrically connected to said electronic actuator; and an encapsulation material surrounding said electronic actuator and an end portion of said elongate tube member, said elongate tube member being coupled to said electronic actuator solely by said encapsulation material.

2. The solenoid assembly of claim 1, wherein said elongate tube member is corrugated to facilitate bending to a non-linear configuration.

3. The solenoid assembly of claim 1, wherein said end portion of said elongate tube member is corrugated to aid in maintaining engagement with said encapsulation material.

4. The solenoid assembly of claim 1, wherein said elongate tube member is an armor tube.

5. The solenoid assembly of claim 4, wherein said armor tube is corrugated along substantially an entire length thereof to facilitate bending to a non-linear configuration and to aid in maintaining engagement with said encapsulation material.

6. The solenoid assembly of claim 4, wherein said armor tube is formed of a metallic material.

7. The solenoid assembly of claim 1, wherein said electronic actuator comprises a coil assembly having a length, said elongate tube member having a length at least one half of said length of said coil assembly.

8. The solenoid assembly of claim 1, wherein said elongate tube member extends along a longitudinal axis laterally offset from said electronic actuator such that a portion of said electrical conductor extending alongside said electronic actuator is embedded within said encapsulation material.

9. The solenoid assembly of claim 1, wherein said electronic actuator includes an actuation member displaceable along an actuation axis, said elongate tube member extending along a longitudinal axis laterally offset from said actuation axis.

10. The solenoid assembly of claim 9, wherein said electronic actuator comprises a coil assembly having a length extending between a first end and an opposite second end, said end portion of said elongate tube member disposed adjacent said first end of said coil assembly, said electrical conductor electrically connected to said coil assembly adjacent said second end, a length of said electrical conductor extending alongside said coil assembly from said first end toward said second end being embedded within said encapsulation material.

11. The solenoid assembly of claim 10, wherein said length of said electrical conductor extends along substantially the entire length of said coil assembly.

12. The solenoid assembly of claim 10, wherein said coil assembly includes:

a bobbin extending along said actuation axis and defining an interior region and an exterior region;

an energizing coil wound about said exterior region of said bobbin; and wherein said actuation member is a plunger disposed within said interior region of said bobbin for reciprocating displacement along said actuation axis.

13. The solenoid assembly of claim 1, further comprising a potting material disposed within said passageway of said elongate tube member and surrounding said electrical conductor.

14. The solenoid assembly of claim 1, wherein said end portion of said elongate tube member is positioned such that a deposit of said encapsulation material is formed about said electrical conductor immediately adjacent said passageway.

15. The solenoid assembly of claim 1, wherein said encapsulation material comprises a reinforced nylon material.

16. A solenoid assembly, comprising:

an electronic actuator;

an elongate armor tube formed of a metallic material and defining a passageway extending therethrough;

an electrical conductor extending through said passageway in said elongate armor tube and electrically coupled to said electronic actuator; and an encapsulation material surrounding said electronic actuator and an end portion of said elongate armor tube to couple said elongate armor tube to said electronic actuator.

17. The solenoid assembly of claim 16, wherein said elongate armor tube is coupled to said electronic actuator solely by said encapsulation material.

18. The solenoid assembly of claim 16, wherein said elongate armor tube is corrugated along a substantial length thereof to facilitate bending to a non-linear configuration.

19. The solenoid assembly of claim 16, wherein said end portion of said elongate armor tube is corrugated to aid in maintaining engagement with said encapsulation material.

20. The solenoid assembly of claim 16, wherein said elongate armor tube is formed of a stainless steel material.

21. The solenoid assembly of claim 16, wherein said elongate armor tube extends along a longitudinal axis laterally offset from said electronic actuator such that a portion of said electrical conductor extending alongside said electronic actuator is embedded within said encapsulation material.

22. The solenoid assembly of claim 16, wherein said electronic actuator includes an actuation member displaceable along an actuation axis, said elongate armor tube extending along a longitudinal axis laterally offset from said actuation axis.

23. The solenoid assembly of claim 22, wherein said electronic actuator comprises a coil assembly having a length extending between a first end and an opposite second end, said end portion of said elongate armor tube disposed adjacent said first end of said coil assembly, said electrical conductor electrically connected to said coil assembly adjacent said second end, a length of said electrical conductor extending alongside said coil assembly from said first end toward said second end being embedded within said encapsulation material.

24. The solenoid assembly of claim 23, wherein said length of said electrical conductor extends along substantially the entire length of said coil assembly.

25. The solenoid assembly of claim 16, further comprising a potting material disposed within said passageway of the elongate armor tube and surrounding said electrical conductor.

26. The solenoid assembly of claim 16, wherein said end portion of said elongate armor tube is positioned such that a deposit of said encapsulation material is formed about said electrical conductor immediately adjacent said passageway.

27. The solenoid assembly of claim 16, wherein said electrical conductor comprises a multi-conductor cable assembly.

28. The solenoid assembly of claim 16, wherein said encapsulation material comprises a reinforced nylon material.

29. The solenoid assembly of claim 28, wherein said reinforced nylon material comprises Nylon 6/6.

* * * * *